United States Patent [19]

Avery

[11] Patent Number: 4,765,494

[45] Date of Patent: Aug. 23, 1988

[54] MARKER CADDY

[76] Inventor: Frederick M. Avery, 3502 E. Cochise Rd., Phoenix, Ariz. 85028

[21] Appl. No.: 119,236

[22] Filed: Nov. 5, 1987

Related U.S. Application Data

[63] Continuation of Ser. No. 899,129, Aug. 22, 1986, abandoned.

[51] Int. Cl.[4] ..... A47F 7/00

[52] U.S. Cl. ..... 211/69.5; 211/128; 206/45

[58] Field of Search ..... 211/126, 128, 69, 133, 211/189, 74, 55, 60.1, 69.5, 69.1, 70.6, 130; 248/128, 129, 130, 146, 371, 393; 206/45, 45.14, 45.18, 45.24, 214

[56] References Cited

U.S. PATENT DOCUMENTS

| | | | |
|---|---|---|---|
| 2,198,459 | 4/1940 | Potts | 211/128 X |
| 3,300,055 | 1/1967 | Rohr | 211/128 |
| 3,865,247 | 2/1975 | Neglia | 211/128 X |
| 4,122,954 | 10/1978 | Slater | 211/133 |

*Primary Examiner*—Ramon O. Ramirez
*Assistant Examiner*—Sarah A. Lechok Eley
*Attorney, Agent, or Firm*—John E. Benoit

[57] ABSTRACT

A marker caddy for holding and displaying a plurality of markers having different cap designs which may be at both ends of the marker, different barrel diameters and heights including a base mounted on wheels, upright support members attached to said base and a frame pivotally mounted at the upper end of the support members. A marker holder is supported within the frame and comprises a plurality of rows of marker trays extending across the width of the holder and extending in a stair-step configuration from the bottom to the top of the holder. The marker is adjustably mounted to said holder so as to be positionable at any selected angle. Each tray includes a plurality of wells at the front of the tray and a plurality of first arcuate indentations at the rear of the tray mating with said wells. Substantially all of trays include a plurality of second arcuate indentations at the rear of the tray which extend above the base of the wells of the adjacent upper tray and align with the wells of the adjacent upper tray. The distance between the extremities between said first and second arcuate indentations being greater than the diameter of said well so as to provide a shelf adjacent the top of said well.

14 Claims, 4 Drawing Sheets

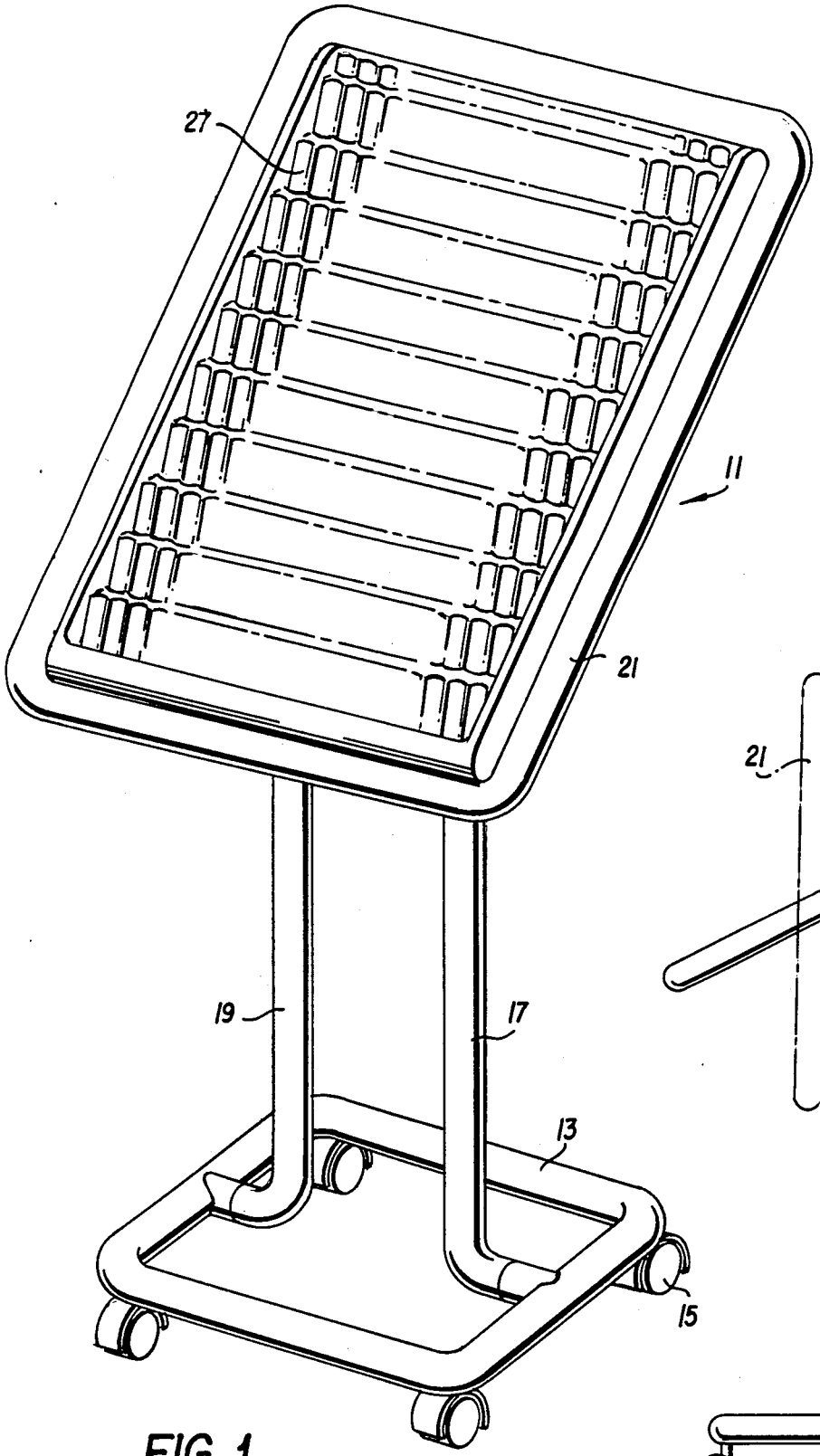
FIG. 1
FIG. 3
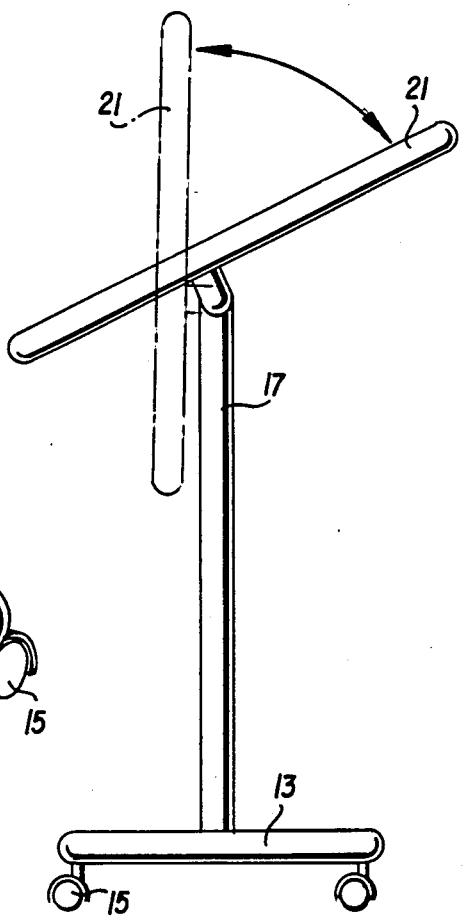

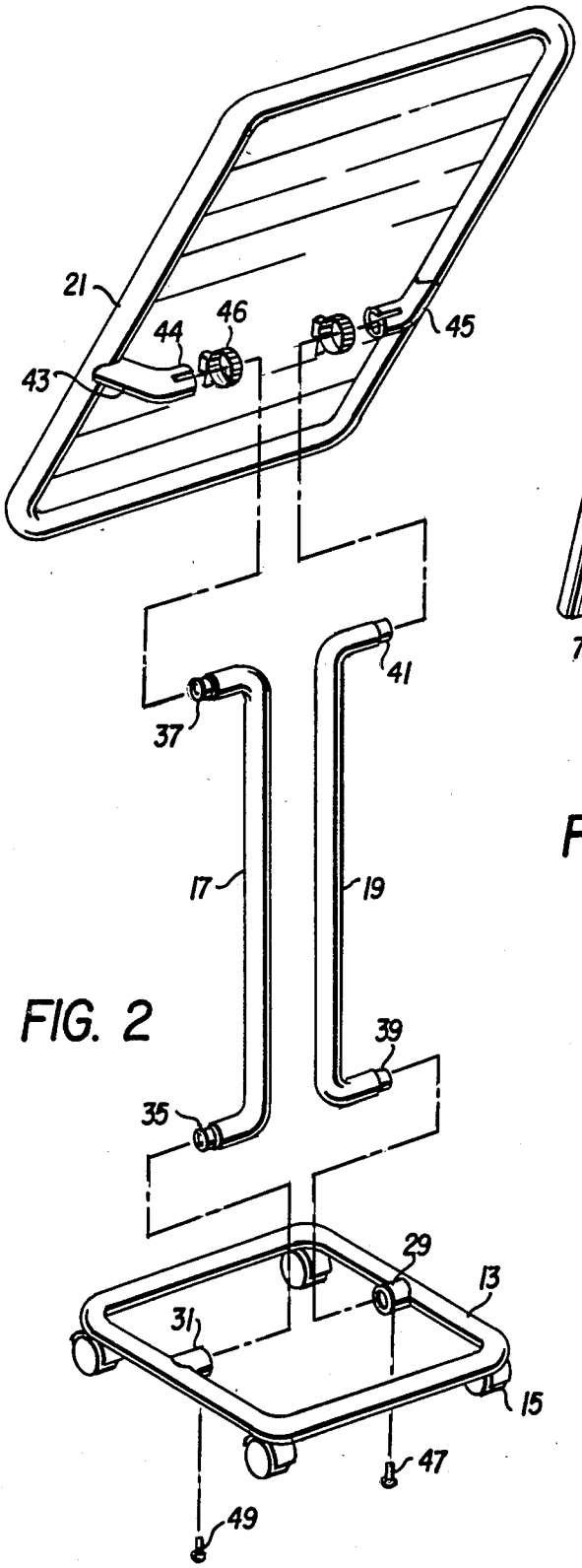
FIG. 2
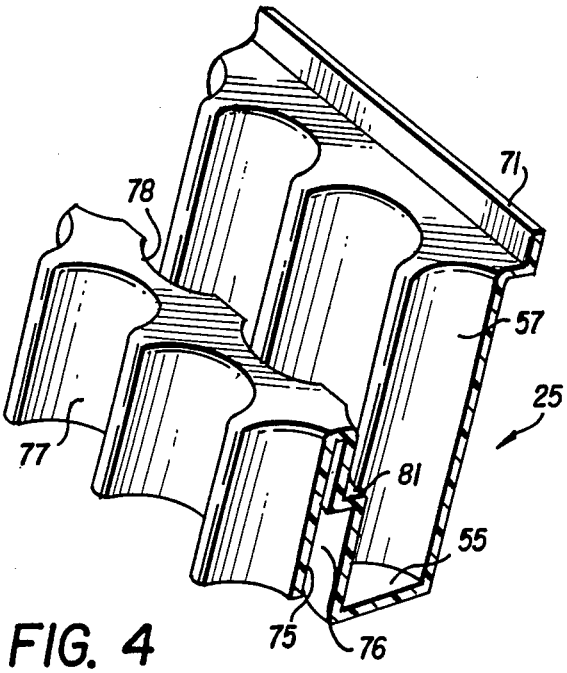
FIG. 4
FIG. 5
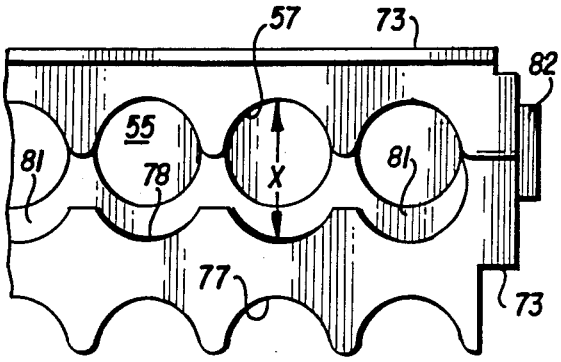

MARKER CADDY

This application is a continuation, of application Ser. No. 899,129, filed Aug. 22, 1986 now abandoned.

This invention relates generally to marker caddies and more specifically to a tray/caddy designed to hold a multiplicity of various types of markers in a convenient and accessible manner.

The use of well known colored markers is extensive for various types of illustrative and other drawing purposes. The person using these markers requires various numbers of markers due to the need of a wide range of colors, values, hues and different functional uses of markers.

Conventional marker trays made by the marker manufacturers are designed to hold only their own specific markers depend on desk, credensa, taboret or drawing table placement, hold a limited number of markers per tray, and, are designed to accommodate only one specific physical shape and size of marker pen.

Markers, and the trays that contain them, are not used at all times during a normal work day by most creative people, and, in some cases, are used only a portion of their working profile. Thus, when they are not being used, the trays available at the present time take up valuable work surface space needed for other art processes and, in short, become a nuisance.

Accordingly, it is an object of the present invention to provide a marker caddy which can be positioned and repositioned if needed next to the designer/creative person in a comfortable position without taking up work surface areas.

It is a further object of the present invention to provide a marker tray which can be placed at any angle and positioned so as to provide easy marker access and best visual selection.

It is a further object of this invention to provide a marker tray which is easily moved to different floor locations when desired and can easily be located to be shared by another creative person.

It is a further object of this invention to provide a marker caddy which provides an orderly, and neat arrangement for storing and color categorizing the markers in one full view.

A still further object of the present invention is to provide a marker caddy having trays which will accommodate substantially all of the generally available marker pens regardless of their bottom configuration, cap design or barrel size.

These and other objects of the present invention will be apparent from the following description when taken together with the drawings.

SUMMARY OF THE INVENTION

The present invention provides a marker caddy for holding and displaying a plurality of markers having different cap designs, bottom configurations, barrel diameters and heights and includes a base which may be mounted on wheels. Upright support members are attached to the base together with a frame pivotally mounted at the upper end of the support members. A marker holder is supported within the frame and comprises a plurality of rows of marker trays extending across the width of the holder and also extending in a stair-step configuration from the bottom to the top of the holder. Each tray includes a plurality of wells in the lower portion of the tray and a plurality of arcuate indentations in the front of the upwardly extending rear portion of the tray mating with the wells. Substantially all of trays include a further plurality of arcuate indentations in the back of the upwardly extending rear portion of the tray, with the upper portion extending above the top of the wells of the next adjacent upper tray and in alignment with and spaced from said wells. This provides a shelf between the top of said wells and the arcuate indentations at the back of the upwardly extending rear portion of the next lower tray whereby markers having barrel sizes larger than said wells can rest upon the shelf and be retained by the indentations. In one embodiment of the invention each row of trays is molded separately and configured so as to mate with the next upper and next lower row of trays so as to form the plurality of rows of marker trays in the desired stairstep configuration. The pivotal mounting frame provides "tilt back" of the tray assembly which permits larger markers to be supported against the indentations even if they do not rest in the wells.

BRIEF DESCRIPTION OF THE DRAWINGS

FIG. 1 is a perspective view of the base and support stand for the marker trays;

FIG. 2 is a perspective exploded view of the rear of the base, support and tray holder showing a preferred construction thereof;

FIG. 3 is a side view of the structure of FIG. 1 illustrating the available angular adjustment of the tray holder;

FIG. 4 is a partial sectional view of one tray level;

FIG. 5 is a partial top view of the tray level of FIG. 4; and

DETAILED DESCRIPTION OF THE PREFERRED EMBODIMENT

Figure 6:
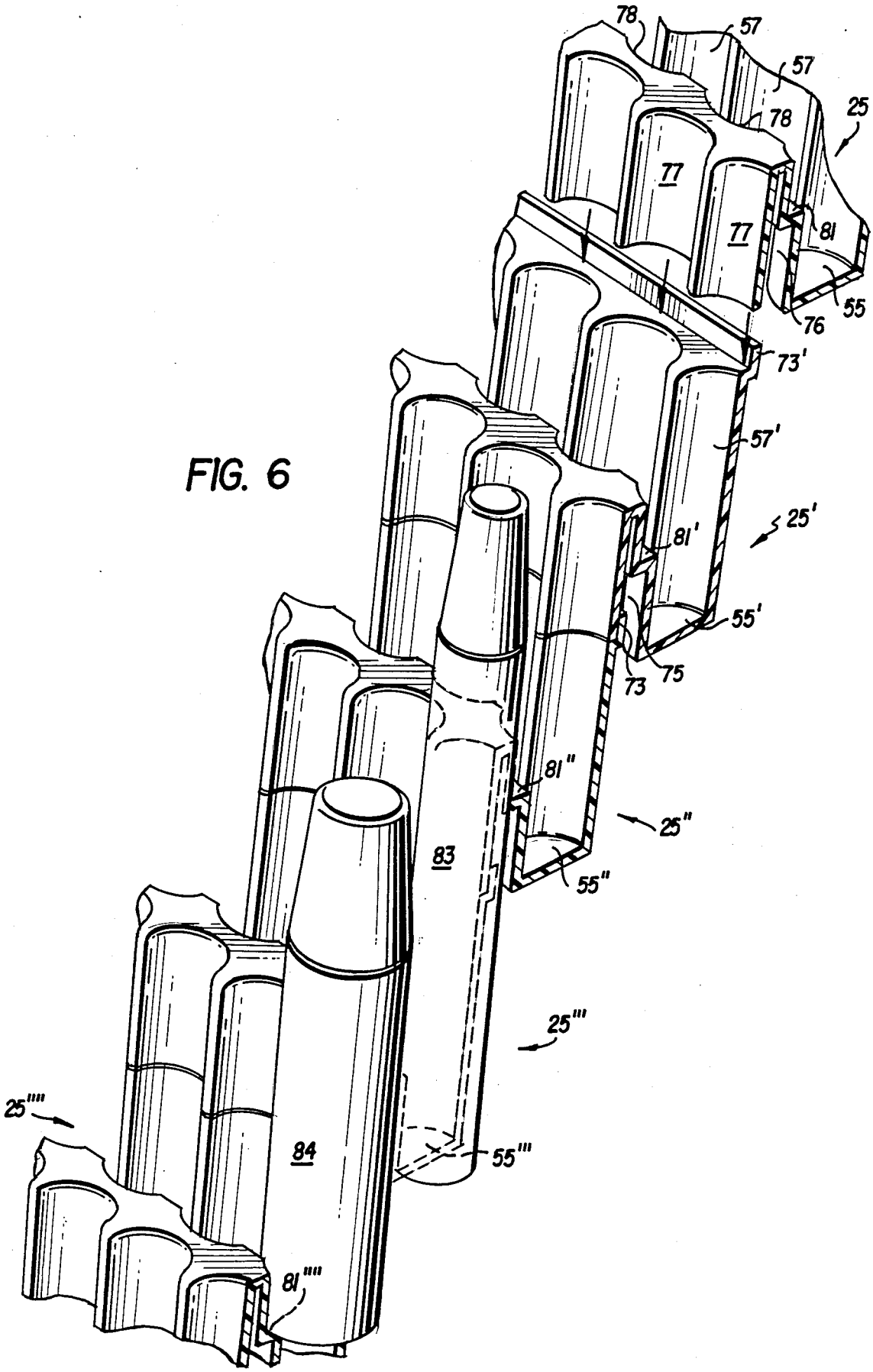
FIG. 6 is a partial sectional view showing the relationship between adjacent stair-stepped trays which creates the additional half round indentation height to assist in holding the barrel of the marker.

Turning now more specifically to the drawings, there is shown in FIG. 1 one embodiment of a marker caddy 11 of the present invention. This caddy includes base 13 mounted on casters 15 with two support legs 17 and 19 extending upwardly from base 13.

Frame 21 is mounted to legs 17 and 19 and carries therein a plurality of marker trays having configurations as generally indicated by trays 25 and 27.

Referring to FIG. 2, one type of construction is shown for the embodiment of the caddy disclosed in FIG. 1. It is understood that this construction is not to be considered limiting of the present invention. As can be seen, base 13 includes two integral hollow cylindrical protrusions 29 and 31. Legs 17 and 19 are generally C-shaped and terminate in reduced sections 35, 37 and 39, 41.

Sections 35 and 39 mate with and pass into hollow cylindrical protrusions 31 and 29 and are secured therein by means such as set screws 47, 49.

Protrusions 37 and 41 at the upper end of legs 17 and 19 mate with hollow elbows 43 and 45 which are integral with frame 21 and extend rearwardly therefrom. Each of the elbows have pressure relief slots 44 and 44'. Once elbows 43 and 45 pass over protrusions 37 and 41, compression clamps 46 fit about the ends of the elbows. Tightening of the compression clamps secures the elbows about protrusions 37 and 41. This permits infinite adjustment of the angular position of frame 21 with respect to support legs 17 and 19 as illustrated in FIG. 3.

Referring now to FIG. 4, each tray contains a basic section 25 which includes a plurality of adjacent wells 55 which extend into the base of the tray. A plurality of arcuate indentations 57 mate with and extend above each well. In the embodiment shown, these indentations are formed by a structure which is integral with the well structure. An upstanding rail 71 is integral with and extends rearwardly of arcuate indentations 57. Wall 75 is integral with the tray structure and extends along the length thereof so as to form channel 76. A further set of arcuate indentations 78 are formed in the side of wall 75 facing wells 55. A still further plurality of arcuate indentations 77 are formed opposite indentations 78 and have substantially the same radius of curvature as arcuate indentations 57. Channel 76 is provided so as to allow rail 71 to rest within channel 76 of the next higher tray for stair-stepping attachment as will be further described hereinbelow.

FIG. 5 is a partial top view of the tray of FIG. 4 which more clearly discloses the arcuate indentations 78 opposed to indentations 77 both of which are in alignment with the adjacent well. Arcuate indentations 78 are located such that the distance x between the extremities of indentations 57 and 78 is greater than the diameter of well 55. Since indentations 78 are not adjacent the well, this creates shelf area 81 extending from the upper edge of the well. The purpose of such a shelf will be apparent from the discussion which follows. Additionally, each tray includes keys 82 at either end which fit into end cap mating slots (not shown) to create the tray assembly which is then mounted into tubular frame caddy.

Turning now to FIG. 6, the unique stair-step configuration of the present invention is shown. Five trays, 25 through 25'''', such as previously described, are shown in attached and unattached positions. Since all trays are attached in the same manner, only one such attachment will be described. In order to attach the trays, rail 73' of tray 25' is fitted into channel 76 of tray 25 as indicated by the arrows. This effectively mates indentations 77 with indentations 57' creating an additional height of indentations 57' and provides further cradle support for markers which rest in well 55' or on shelf 81'.

FIG. 6 further illustrates the versatility of the tray in adapting to markers having different bottom configuration, cap design or barrel size. Marker 84 is shown as having a barrel size larger than well 55'''. Such a marker rests on shelf area 81''' and is supported by opposite arcuate indentations. Marker 83 has a barrel size which fits within well 55'''' and is supported by the well and the adjacent arcuate indentations. It should be noted that the uppermost tray as illustrated in FIG. 1 terminates with arcuate indentation 57 which results in a one-half stair-step. This is still adequate for markers which fit within the well.

The construction of the marker trays as described above provides an economical process for molding the components and asembling same. However, it should be understood that the entire stair-step tray structure could be produced as one piece from a single mold.

As will now be evident, the present invention provides an "unselfish" marker caddy. This tray, when used in the stair-step fashion as described above, creates a back support cradle to hold the barrel portion of most marker pens. The shelf created on each level spaced from the wells is designed to accommodate pens having a barrels larger in diameter than the wells. This combination of recessed wells, front and rear arcuate supports and stair-stepping, together with the adjustable tray angle or "tilt back", creates a structure which holds and cradles substantially all of the known sizes of commercial markers in use today.

Additionally, the fact that the marker tray may be adjusted to various positions by pivoting, as described above, allows the user to position the markers at the best angle for viewing and selection.

Finally, the ability to move the marker between work areas, and even into positions where it may be jointly shared, removes the marker from the work surface so as to provide greater work surface as well as greater flexibility in the use of the markers.

The above description and drawings are illustrative only since modifications in structure and relative locations could be varied without departing from the invention, the scope of which is to be limited only by the following claims.

We claim:

1. A marker caddy comprising a base;

support members secured to and extending above said base;

a frame having upper, lower and side members mounted on the upper ends of said support members;

a marker holder mounted within said frame, said marker holder including a plurality of adjacent rows of marker trays mounted substantially parallel between the sides of said frame in a stair-step configuration, each of said marker trays comprising a plurality of adjacent substantially vertical wells in the lower portion of said tray;

a first plurality of adjacent substantially arcuate indentations in the upper rear portion of said tray equal in number and mating with and extending above said wells;

an upward integral extension of said arcuate indentations on substantially all of said trays adjacent to and extending above the next higher level of said wells; and a second plurality of substantially arcuate indentations in the rear of said extension, said second indentations being substantially aligned with, displaced from, and extending above said next higher level of wells, the distance between the opposed extremities of said second indentations and said first indentations being greater than the diameter of said adjacent well so as to provide a shelf adjacent to the top of said well.

2. The marker caddy of claim 1 further comprising adjustable means for mounting said frame to said support members so that said frame may be positioned at any selected angle relative to said support members.

3. The marker caddy of claim 1 further comprising casters mounted on said base so that said caddy is movable to selected locations.

4. The marker caddy of claim 1 wherein said support members are removable from said base and said frame is removable from said support members.

5. A marker caddy comprising a frame having upper, lower, and side members;

support means for said frame;

a marker holder mounted within said frame, said marker holder comprising;

a plurality of adjacent rows of marker trays mounted substantially parallel between the sides of said frame in a stair-step configuration, each of said marker trays comprising a plurality of adjacent wells in the lower portions of said tray;

a first plurality of adjacent substantially arcuate indentations in the upper portion of said tray equal in number, mating with and extending above said wells;

an upward integral extension of said upper portion of said first plurality of arcuate indentations extending adjacent to and above the next higher level of said wells; and a second plurality of arcuate indentations in the rear of said upward extension displaced from and substantially aligned with said next higher level of wells, the distance between the opposed extremities of said second indentations and said first indentations being greater than the diameter of said adjacent well so as to provide a shelf adjacent the top of said well.

6. The marker caddy of claim 5 further comprising adjustable means for mounting said frame to said support means so that said tray may be positioned at any selected angle relative to said support means.

7. The marker caddy of claim 1 wherein each of said rows of marker trays are individual molded units and further comprise an upstanding rail extending rearwardly of said upper rear portion;

a third plurality of arcuate indentations in opposed juxtaposition to said second plurality of arcuate indentations extending above and below the top of said wells; and a channel between said wells and said third arcuate indentations;

said channel being of a dimension to accept said rail of a like row of marker trays whereby a plurality of said rows of marker trays may be interconnected in a stair-step configuration with said first and third rows of indentations being in alignment.

8. The marker caddy of claim 5 wherein each of said rows of marker trays are individual molded units and further comprise an upstanding rail extending rearwardly of said upper rear portion;

a third plurality of arcuate indentations in opposed juxtaposition to said second plurality of arcuate indentations extending above and below the top of said wells; and a channel between said wells and said third arcuate indentations;

said channel being of a dimension to accept said rail of a like row of marker trays whereby a plurality of said rows of marker trays may be interconnected in a stair-step configuration with said first and third rows of indentations being in alingment.

9. A marker caddy comprising a frame having upper, lower, and side members;

support means for said frame;

a marker holder having a plurality of adjacent unitary rows of marker trays mounted with said frame, each of said rows of marker trays comprising a plurality of adjacent wells;

a first plurality of substantially arcuate indentations adjacent to and extending above said wells;

a second plurality of substantially arcuate identations being substantially aligned with, displaced from, and extending above the top of said wells opposite said first plurality of indentations;

a third plurality of substantially arcuate indentations in opposed juxtaposition to said second arcuate indentations extending above and below the top of said wells; and means for interlocking said plurality of rows of marker trays in a stair-step configuration wherein said first and third rows of indentations are vertically mated.

10. A marker caddy comprising a base;

support members secured to and extending above said base;

a frame having upper, lower, and side members mounted on the upper ends of said support members;

a marker holder mounted within said frame, said marker holder including a plurality of adjacent rows of marker trays mounted substantially parallel between the sides of said frame in a stair-step configuration, each of said marker trays comprising a plurality of adjacent substantially vertical wells in the lower portion of said tray;

a first plurality of adjacent substantially arcuate indentations in the upper rear portion of and integral with said tray equal in number and mating with and extending above the top of said wells;

a second plurality of adjacent substantially arcuate indentations in the upper forward portion of and integral with said tray substantially aligned with, displaced from, and extending above the top of said wells opposite said first plurality of indentations.

11. The marker caddy of claim 10 further comprising adjustable means for mounting said frame to said support members so that said frame may be positioned at any selected angle relative to said support members.

12. The marker caddy of claim 10 further comprising casters mounted on said base so that said caddy is movable to selected locations.

13. The marker caddy of claim 10 wherein said support members are removable from said base and said frame is removable from said support members.

14. A marker caddy comprising a base;

support means secured to and extending above said base;

rotatable means mounted to and supporting said base so as to permit said base to be freely movable to selected locations;

a marker holder mounted in said frame, said marker holder comprising a plurality of stair-steps;

a plurality of substantially adjacent wells in each stair-step; and cradle means integral with each stair-step and extending above opposite sides of and laterally displaced from each of said wells so that said wells and said cradle means can individually accept, support, and cradle markers having differing diameters and differing geometrical configurations.

* * * * *